United States Patent [19]

Zunkel et al.

[11] Patent Number: 4,567,944

[45] Date of Patent: Feb. 4, 1986

[54] RETRIEVABLE STRADDLE PACKER

[75] Inventors: Gary D. Zunkel, Chickasha, Okla.; Samuel W. Cantrell, Casper, Wyo.

[73] Assignee: Halliburton Company, Duncan, Okla.

[21] Appl. No.: 578,730

[22] Filed: Feb. 9, 1984

[51] Int. Cl.[4] ..... E21B 33/124

[52] U.S. Cl. ..... 166/120; 166/127; 166/147; 166/191

[58] Field of Search ..... 166/127, 147, 138, 191, 166/120, 216

[56] References Cited

U.S. PATENT DOCUMENTS

| | | | |
|---|---|---|---|
| 2,675,876 | 4/1954 | Conrad et al. | 166/127 |
| 2,715,444 | 8/1955 | Fewel . | |
| 2,831,541 | 4/1958 | Conover . | |
| 3,338,308 | 8/1967 | Elliston et al. | 166/138 |
| 3,398,796 | 8/1968 | Fisher, Jr. et al. | 166/127 |
| 4,279,306 | 7/1981 | Weitz . | |

OTHER PUBLICATIONS

Halliburton Services Sales and Service Catalog No. 41, pp. 4013–4015, (RTTS Packer).

Halliburton Services Sales and Service Catalog No. 41, pp. 4019 and 4020, (Surge Perforation Cleaning).

Halliburton Services Sales and Service Catalog No. 41, pp. 4031 and 4032, (Selective Injection Packer).

*Primary Examiner*—Stephen J. Novosad

*Assistant Examiner*—Bruce M. Kisliuk

*Attorney, Agent, or Firm*—James R. Duzan; Thomas R. Weaver

[57] ABSTRACT

An improved retrievable compression set straddle packer assembly for use in oil and gas wells. The straddle packer assembly comprises an upper hydraulic slip assembly, an upper packer assembly, a bypass assembly, a lower packer assembly, a lower mechanical slip assembly and lower drag block assembly.

19 Claims, 14 Drawing Figures

RETRIEVABLE STRADDLE PACKER

BACKGROUND OF THE INVENTION

This invention relates to an improved packer for oil and gas wells. More specifically, the invention relates to an improved retrievable compression set straddle packer assembly for cleaning operations in oil and gas wells.

In many types of oil and gas wells it is desirable to inject into the perforations in the casing in the well bore to remove debris and produced materials therefrom to allow formation fluids and gases to freely flow into the well bore. Typically, such injecting operations have been performed using a retrievable packer having frusto-conical type cups thereon to isolate the perforations to be washed. However, such cup-type packers are susceptible to damage of the frusto-conical cups as they pass over the perforations in the casing, pass through dry casing or pass through casing liners and cannot be used with high differential fluid pressures acting across the frusto-conical cups to prevent the cups from being damaged.

Therefore, in certain instances, it is desirable to have a retrievable compression set straddle packer assembly having two sets of compression set packer elements thereon to isolate perforations in the casing in the well bore for washing.

Also, it is desirable to have such a retrievable compression set straddle packer assembly to use as a selective injection packer to isolate portions of the well bore for fluid injection operations where the length of the packer assembly between the compression set packer elements may be easily varied for use in a wide variety of well operations.

STATEMENT OF THE INVENTION

The present invention is directed to an improved retrievable compression set straddle packer assembly for use in oil and gas wells. The straddle packer assembly of the present invention comprises an upper hydraulic slip assembly, an upper packer assembly, a bypass assembly, a lower packer assembly, a lower mechanical slip assembly and lower drag block assembly.

BRIEF DESCRIPTION OF THE DRAWINGS

The advantages of the present invention will be more fully understood from the following description and drawings wherein.

DESCRIPTION OF THE INVENTION

Figure 1:
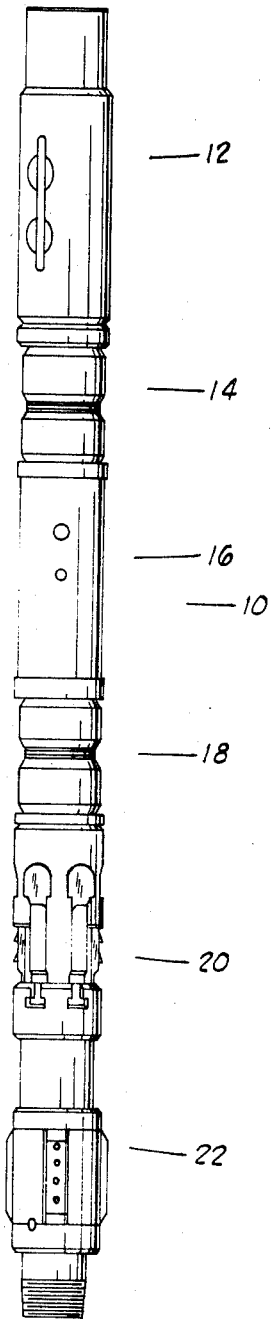
FIG. 1 is a view of a first embodiment of the retrievable straddle packer assembly of the present invention.

Referring to FIG. 1, a first embodiment 10 of the retrievable straddle packer assembly of the present invention is shown.

The retrievable straddle packer assembly 10 comprises an upper hydraulic slip assembly 12, an upper packer assembly 14, a bypass assembly 16, a lower packer assembly 18, a lower mechanical slip assembly 20 and lower drag block assembly 22.

Figure 2A:
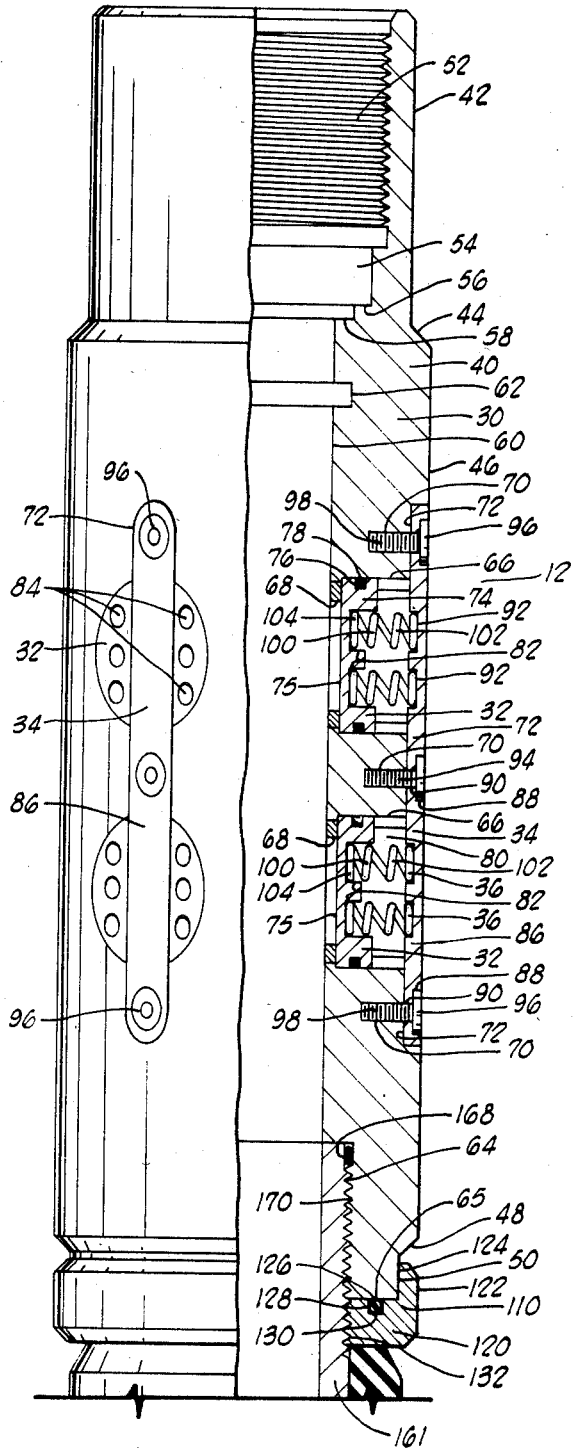
FIGS. 2A through 2D illustrate the first embodiment of the retrievable straddle packer assembly of the present invention shown in FIG. 1 in enlarged partial cross-section.

Referring to FIG. 2A, the upper hydraulic slip assembly 12 of the retrievable straddle packer 10 of the present invention is shown.

The upper hydraulic slip assembly 12 comprises a hydraulic hold down body 30, a plurality of hydraulic slips 32 retained within body 30, a plurality of hydraulic hold down straps 34 retaining the plurality of hydraulic slips 32 within body 30 and a plurality of hydraulic slip retractor springs 36 biasing the plurality of slips 32 in a retracted position within body 30.

The hydraulic hold down body 30 comprises an annular elongated cylindrical member 40 having, on the exterior thereof, a first cylindrical portion 42, first annular chamfered shoulder 44, second cylindrical portion 46, second annular chamfered shoulder 48 (see FIG. 2A) and third cylindrical portion 50 (see FIG. 2A) and, on the interior thereof, first threaded bore 52, first cylindrical bore 54, first annular shoulder 56, second annular shoulder 58, second cylindrical bore 60 having, in turn, annular recess 62 therein, and second threaded bore 64 (see FIG. 2A).

The hydraulic hold down body 30 further includes a plurality of first bores 66 and second bores 68 having, in turn, a diameter smaller than first bores 66 extending through the body 30 from the second cylindrical portion 46 on the exterior of the body 30 to the second cylindrical bore 60 on the interior thereof, a plurality of threaded apertures 70 extending partially through body 30 extending inwardly from second cylindrical portion 46 of body 30, and a plurality of elongated recesses 72 in second cylindrical portion 46 of body 30, a portion of each elongated recess 72 extending over each first bore 66 in the body 30.

Retained within each first bore 66 in the hydraulic hold down body 30 is a cylindrical hydraulic slip 32. The hydraulic slip 32 comprises a cylindrical member 74 having an annular recess 76 in the exterior thereof having, in turn, annular elastomeric seal 78 therein, an elongated slot 80 extending through a portion thereof, a plurality of recesses 82 therein, and a plurality of teeth 84 thereon. The bottom 75 of each hydraulic slip 32 is in fluid communication with the second cylindrical bore 60 of hydraulic hold down body 30 via second bore 68 in the body 30.

Each hydraulic hold down strap 34 comprises an elongated, generally rectangular in cross-section member 86 having a width such that the member 86 readily is received within elongated recess 72 in hydraulic hold down body 30 and such that the elongated slot 80 in each slip 32 is wider than the width of member 86, having a plurality of first bores 88 and second bores 90 extending therethrough and having a plurality of circular recesses 92 therein. Each hydraulic hold down strap 34 is releasably secured to hydraulic hold down body 30 by a plurality of threaded fasteners 94, each fastener 94 having the head 96 thereof received in first bore 88 of strap 34 and the threaded body 98 thereof extending through second bore 90 of strap 34 threadedly engaging threaded aperture 70 in body 30.

The hydraulic slip retractor springs 36 each comprise a coil wound type spring member 100 having one end 102 thereof retained within circular recess 92 of hydraulic hold down strap 34 and the other end 104 thereof received within recess 82 in hydraulic slip 32.

The hydraulic slip retractor springs 36 resiliently bias hydraulic slips 32 within first bores 66 within hydraulic hold down body 30.

Figure 2B:
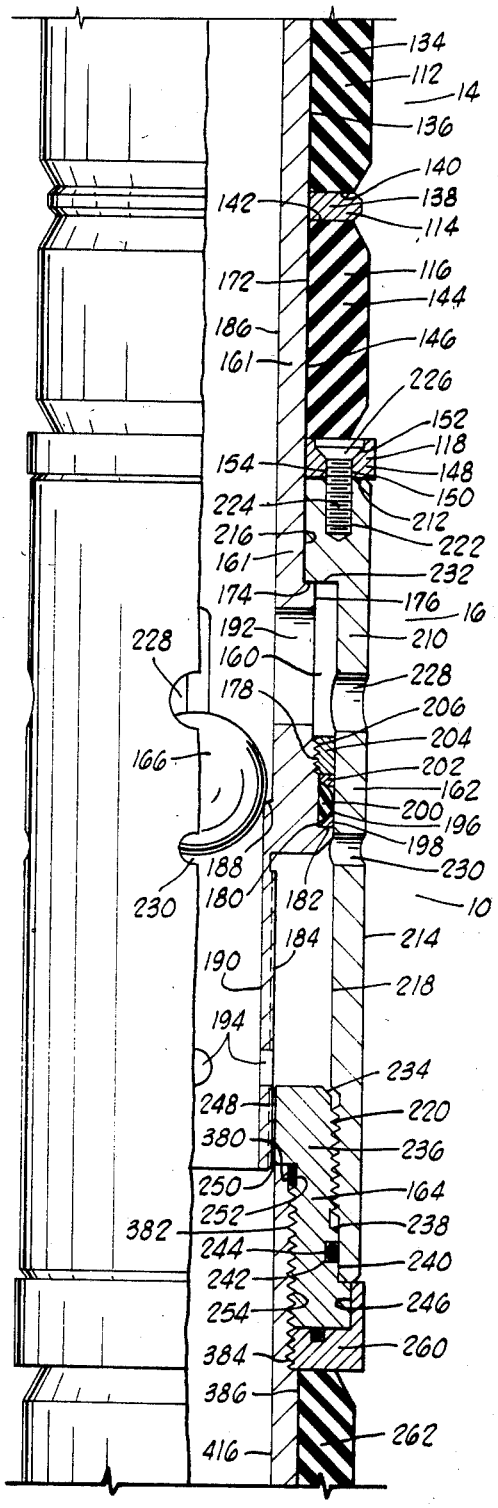

Referring to FIGS. 2A and 2B, the upper packer assembly 14 comprises an upper shoe 110, a first packer element 112, spacer 114, a second packer element 116 and lower shoe 118.

The upper shoe 110 comprises an annular cylindrical member 120 having, on the exterior thereof, cylindrical portion 122 and, on the interior thereof, cylindrical bore 124 which slidingly engages third cylindrical portion 50 of hydraulic hold down body 30, annular shoulder 126 having, in turn, annular recess 128 having annular elastomeric member 130 therein and threaded bore 132.

The annular elastomeric member 130 sealingly engages annular end surface 65 of hydraulic hold down body 30 when shoulder 126 of upper shoe 110 abuts end surface 65 of body 30.

First packer element 112 comprises an annular elastomeric member 134 having a bore 136 therethrough.

The spacer 114 comprises an annular member 138 having an upper surface 140, a lower surface 142, and a bore therethrough.

The second packer element 116 comprises an annular elastomeric member 144 having a bore 146 therethrough.

The lower shoe 118 comprises an annular member 148 having a plurality of apertures 150 therethrough, each aperture 150 comprising a cylindrical frusto-conical portion 152 and a cylindrical portion 154.

Referring to FIG. 2B, the bypass assembly 16 comprises upper mandrel assembly 160, bypass body 162, connector nut 164 and ball sealer 166.

The upper mandrel assembly 160 comprises upper mandrel 161, annular sliding sealing member 196 and annular nut 204.

The upper mandrel 161 comprises an elongated annular member having, on the exterior thereof, a first cylindrical portion 168, first threaded portion 170 which sealingly mates with threaded bore 64 of hydraulic hold down body 30, second cylindrical portion 172, first annular shoulder 174, third cylindrical portion 176, second threaded portion 178, fourth cylindrical portion 180, second annular shoulder 182 and a plurality of splines 184 and, on the interior thereof, first bore 186, annular shoulder 188 and second bore 190. Extending from third cylindrical portion 176 to bore 186 through elongated annular member 161 are a plurality of slots or apertures 192. Similarly, a plurality of holes or apertures 194 extend through elongated annular member 161 extending from the splines 184 to bore 190.

Retained upon fourth cylindrical portion 180 on the exterior of upper mandrel 161 is annular sliding sealing member 196. The annular sliding sealing member 196 is formed having a first annular metal back-up member 198 which abuts second annular shoulder 182 on the exterior of elongated annular member 161 when the sealing member 196 is assembled thereon, an annular elastomeric member 200 which slidingly sealingly engages second cylindrical bore 218 of bypass body 162 and second annular metal back-up member 202.

To releasably retain sealing member 196 on the elongated annular member 161 an annular nut 204 having threaded bore 206 therethrough which mates with second threaded portion 178 on the exterior of member 161 is used. The annular nut 204 is installed on elongated annular member 161 having one end thereof abutting second annular metal back-up member 202 of annular seal 196.

The bypass body 162 comprises an elongated annular member 210 having, on the exterior thereof, cylindrical portion 214 and, on the interior thereof, first cylindrical bore 216 which slidingly engages second cylindrical portion 172 on the exterior of elongated annular member 161 of upper mandrel assembly 160, second cylindrical bore 218, threaded bore 220, and third cylindrical bore 221. The upper end 212 of bypass body 162 is formed having a plurality of threaded apertures 222 therein which receive a portion of threaded fasteners 224 therein. The threaded fasteners 224 releasably secure lower shoe 118 of the upper packer assembly 14. The heads 226 of the threaded fasteners 224 are retained in the cylindrical frusto-conical portion 152 of the apertures 150 in lower shoe 118.

Extending through bypass body 162 from cylindrical portion 214 on the exterior thereof to second cylindrical bore 218 on the interior thereof are a plurality of first apertures 228 and second apertures 230.

The bypass body 162 further has a portion of annular shoulder 232 abutting annular shoulder 174 of the elongated annular member 161 of upper mandrel assembly 160.

The connector nut 164 comprises an annular member having, on the exterior thereof, first annular frusto-conical surface 234, threaded portion 236, second annular frusto-conical surface 238, first cylindrical portion 240 having, in turn, annular recess 242 therein having annular elastomeric sealing member 244 therein which sealingly engages third cylindrical bore 221 of the bypass body 162, and second cylindrical portion 246 and, on the interior thereof, bore 248 having, in turn, a plurality of longitudinal passageways 250 therein, each passageway slidingly receiving therein a spline 184 on the elongated annular member 161 of the upper mandrel assembly 160, cylindrical bore 252 and threaded bore 254.

The ball sealer 166 comprises a spherical member which sealingly engages annular shoulder 188 of the upper mandrel 161 of the upper mandrel assembly 160 with the sealer 166 contained therein. When the ball sealer 166 is contained within upper mandrel assembly 160, the ball sealer 166 permits substantially unobstructed flow through apertures 192 in annular elongated member 161.

Figure 2C:
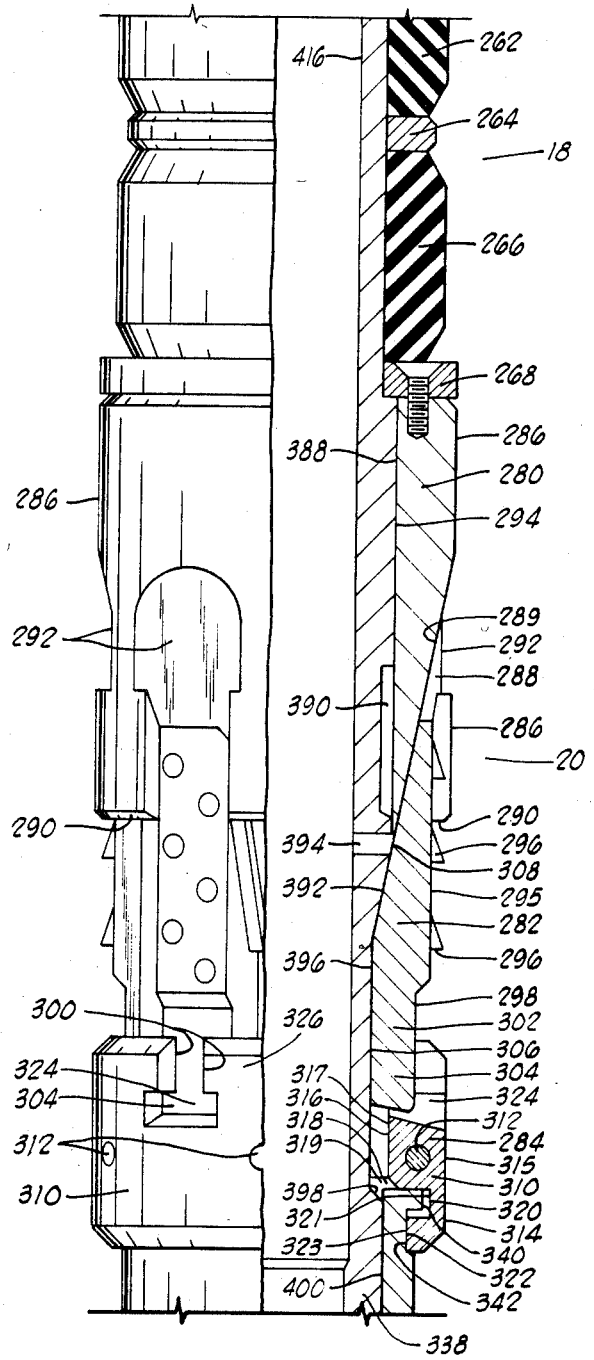

Referring to FIGS. 2B and 2C, the lower packer assembly 18 comprises an upper shoe 260, a first packer element 262, spacer 264, a second packer element 266 and lower shoe 268.

The lower packer assembly 18 and individual members thereof are similar in construction to upper packer assembly 14.

The lower mechanical slip assembly 20 comprises mechanical slip body 280, a plurality of slips 282, and a split slip ring collar assembly 284.

The mechanical slip body 280 comprises an annular cylindrical member having, on the exterior thereof, cylindrical portion 286 having a plurality of wedge shaped recesses 288 therein, each recess 288 extending from the lower end 290 of the slip body 280 to an intermediate portion or position terminating rectangular shaped recess 292 on the body to provide a wedge shaped ramp upon which a slip 282 slides and, on the interior thereof, cylindrical bore 294.

Each slip 282 comprises an elongated member having a generally rectangular in cross-section shape throughout a portion of its length. The slip 282 is formed having an arcuate exterior surface 295 having, in turn, a plurality of wedge shaped gripping members 296 protruding therefrom, arcuate exterior surface 298, recess 300 on each side of bottom portion 302 of slip 282 thereby forming a T-shaped lug 304 on the end of the bottom portion 302, arcuate inner surface 306 and arcuate frusto-conical surface 308 which slidingly engages surface 289 of each recess 288 in mechanical slip body 280.

The split ring collar assembly 284 comprises a plurality of arcuate shaped collar members 310 secured to each other forming the assembly by means of a plurality of threaded fasteners 312. Each collar member 310 comprises an arcuate shaped member having arcuate outer surface 314, first arcuate inner surface 316, frusto-conical surface 318, second inner arcuate surface 320, and third inner arcuate surface 322. Each collar member 310 is further formed having one or more, or portions thereof, T-shaped recesses 324 therein in upper portion 326 of the member 310 within which T-shaped lug 304 of slip 282 is slidingly received.

When the collar members 310 are assembled into split ring collar assembly 284 the arcuate surfaces 314, 316, 320 and 322 form cylindrical outer surface 315 and bores 317, 321 and 323, respectively, of the collar 284 while frusto-conical surfaces 318 forms annular frusto-conical surface 319 of the collar 284.

Figure 2D:
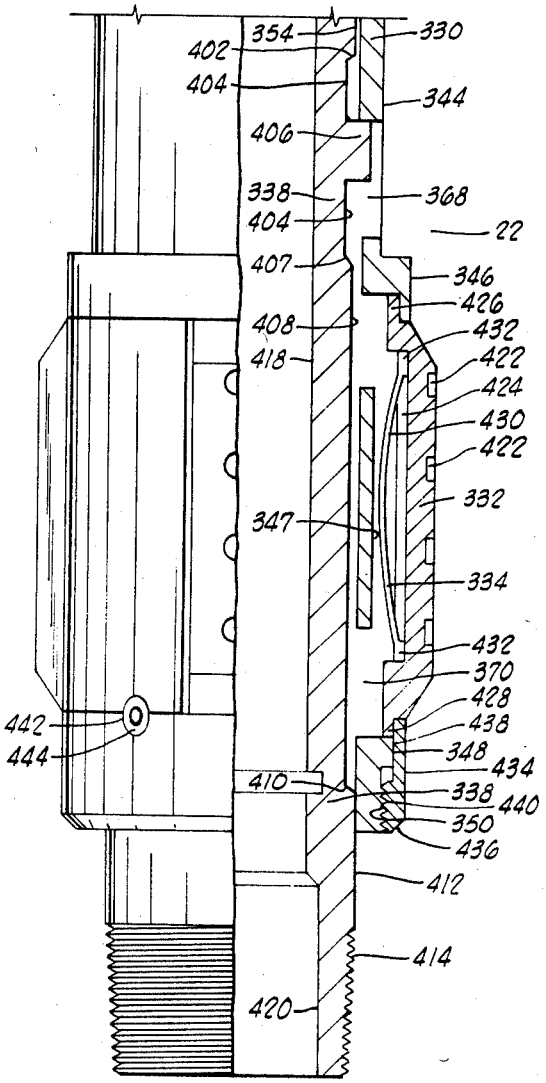

Referring to FIGS. 2C and 2D, the drag block assembly 22 comprises drag block sleeve 330, a plurality of drag blocks 332, a plurality of drag block springs 334, drag block sleeve nut 336 and lower mandrel 338.

The drag block sleeve 330 comprises an elongated annular member having, on the exterior thereof, first cylindrical portion 340, annular recess 342, second cylindrical portion 344, third cylindrical portion 346, fourth cylindrical portion 347, fifth cylindrical portion 348 and threaded portion 350 and, on the interior thereof, cylindrical bore 354. The drag block sleeve 330 further includes J-shaped slot 368 therein and a plurality of recesses 370 therein which receive portions of drag block 332 therein and drag springs 334 therein.

Referring to FIGS. 2B, 2C and 2D, the lower mandrel 338 comprises an elongated, annular member having, on the exterior thereof, first cylindrical portion 380, first threaded portion 382, second cylindrical portion 384, third cylindrical portion 386, fourth cylindrical portion 388 having, in turn, annular recess 390 therein, first frusto-conical annular portion 392 which is complementary to the frusto-conically shaped recesses 288 in slip body 280, and having, in turn, a plurality of apertures 394 therein, fifth cylindrical portion 396, second frusto-conical annular surface 398, sixth cylindrical portion 400, third frusto-conical annular surface 402, seventh cylindrical portion 404 having, in turn, lug 406 thereon which slidably engages J-shaped slot 368 in drag block sleeve 330, fourth frusto-conical annular surface 407, eighth cylindrical portion 408, fifth frusto-conical annular surface 410, ninth cylindrical portion 412 and second threaded portion 414, and, on the interior thereof, first cylindrical bore 416 having, in turn, apertures 394 therein, second cylindrical bore 418 and third cylindrical bore 420.

Referring to FIG. 2D, each drag block 332 comprises an elongated member having, on the exterior thereof, a plurality of teeth 422, and, on the interior thereof, recess 424. One end 426 of each drag block 332 is retained within a portion of recess 370 of drag block sleeve 330.

Each drag block spring 334 comprises an elongated resilient member having a bow portion 430 which abuts fourth cylindrical portion 347 of drag block sleeve 330 and end portions 432 which are received in recess 424 of each drag block 332 abutting the interior thereof.

Drag block sleeve nut 336 comprises an annular cylindrical member having, on the exterior thereof, cylindrical portion 434 and frusto-conical annular surface 436 and, on the interior thereof, cylindrical bore 438 which receives an end 428 of each drag block 428 therein and threaded bore 440 which threadably, releasably engages threaded portion 350 of drag block sleeve 330. The drag block sleeve nut 336 further includes an aperture 442 having, in turn, a portion thereof threaded which receives fastener 444 therein to releasably secure nut 336 to drag block sleeve 330.

Figure 3:
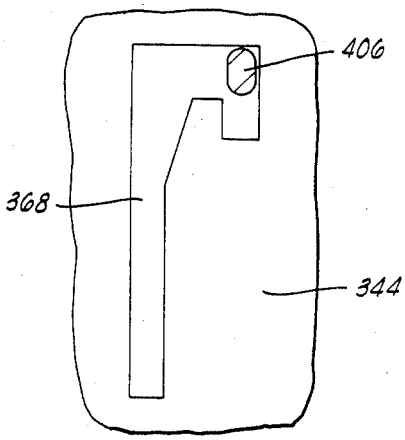
FIG. 3 is a partial view of the drag block sleeve of a first embodiment of the retrievable straddle packer assembly of the present invention showing the J-shaped slot in the drag block sleeve.

Referring to FIG. 3, the J-shaped slot 368 in drag block sleeve 330 having lug 406 of the lower mandrel 338 slidably retained therein in a first position therein is shown.

Figure 4A:
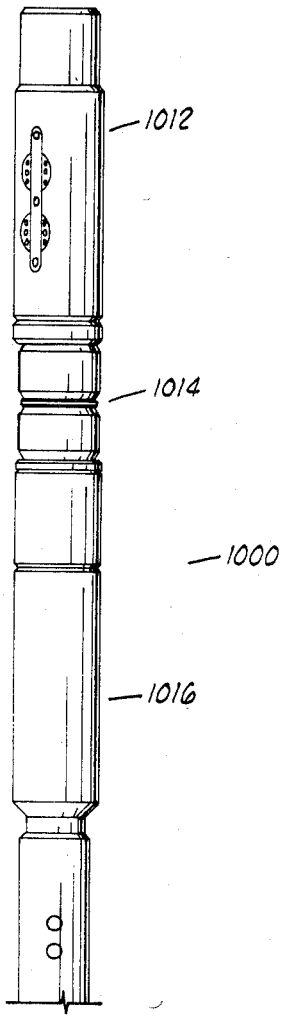
FIG. 4 is a view of a second embodiment of the retrievable straddle packer assembly of the present invention.
Figure 4B:
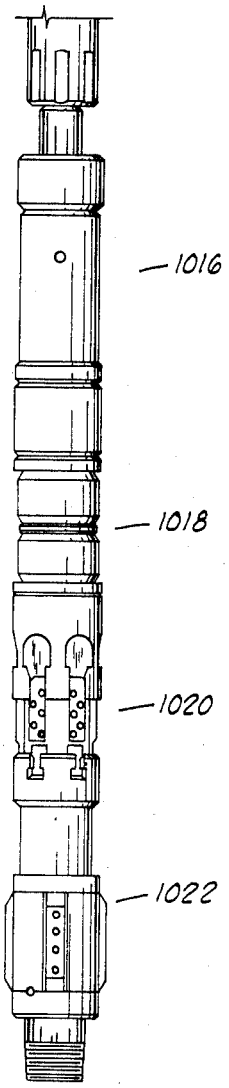

Referring to FIGS. 4A and 4B, a second embodiment 1000 of the retrievable straddle packer assembly which is preferred for use in wells where it is desired to vary the length of the bypass assembly is shown.

The second embodiment 1000 of the retrievable straddle packer assembly comprises an upper hydraulic slip assembly 1012, an upper packer assembly 1014, a variable length bypass assembly 1016, a lower packer assembly 1018, a lower mechanical slip assembly 1020 and a lower drag block assembly 1022.

Figure 5A:
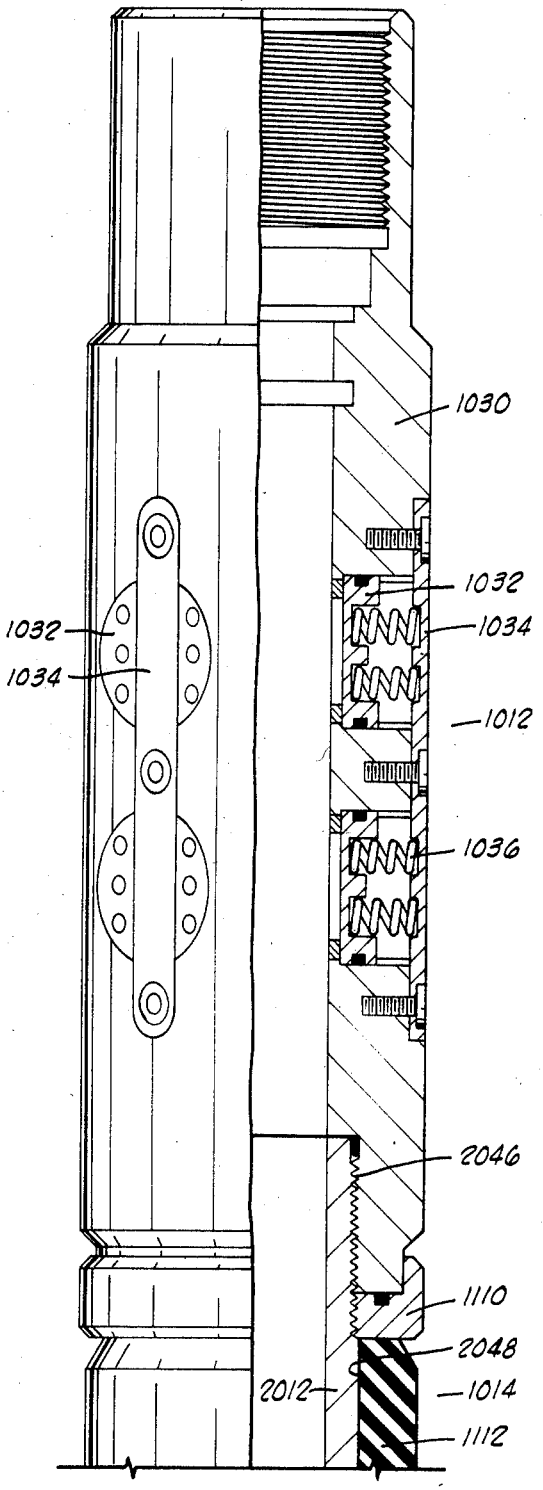
FIGS. 5A through 5F illustrate the second embodiment of the retrievable straddle packer assembly of the present invention shown in FIG. 4 in enlarged cross-section.
Figure 5B:
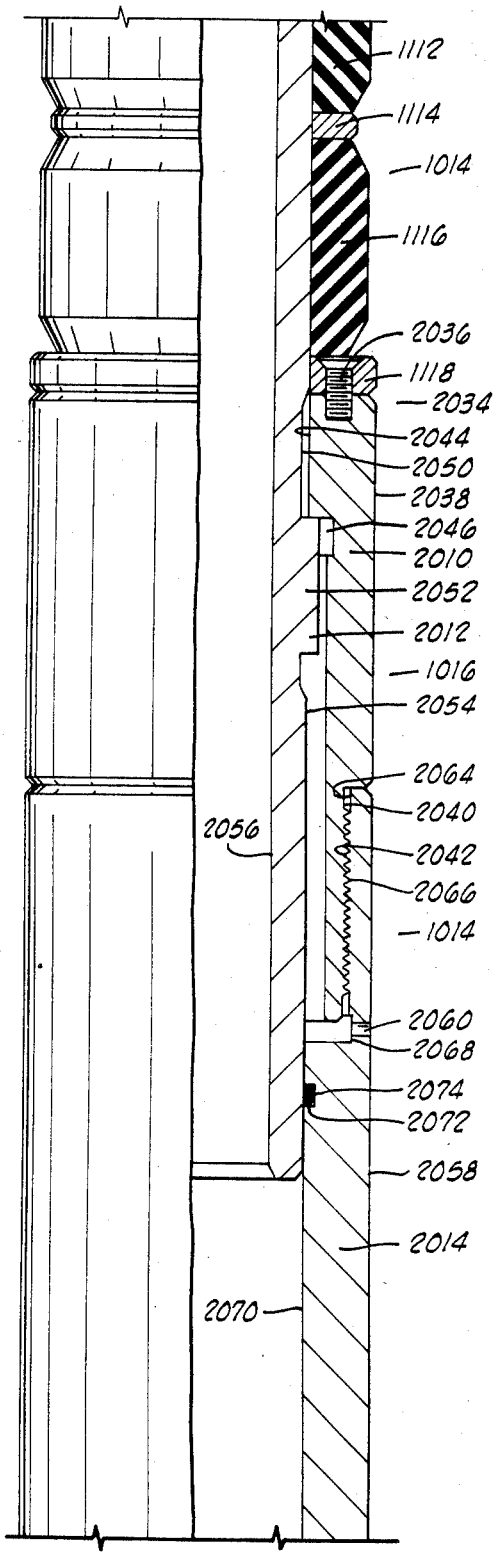

Referring to FIGS. 5A and 5B, the upper hydraulic slip assembly 1012 of the second embodiment 1000 is the same as that of assembly 12 in the first embodiment 10 described hereinbefore.

The upper hydraulic slip assembly 1012 comprises a hydraulic hold down body 1030, a plurality of hydraulic slips 1032 retained within body 1030, a plurality of hydraulic hold down straps 1034 retaining the plurality of hydraulic slips 1032 within body 1030 and a plurality of hydraulic slip retractor springs 1036 biasing the plurality of slips 1032 in a retracted position within the body 1030.

The upper packer assembly 1014 of the second embodiment 1000 is the same as that of assembly 14 of the first embodiment 10 described hereinbefore.

The upper packer assembly 1014 comprises an upper shoe 1110, a first packer element 1112, spacer 1114, a second packer element 1116 and lower shoe 1118.

Figure 5C:
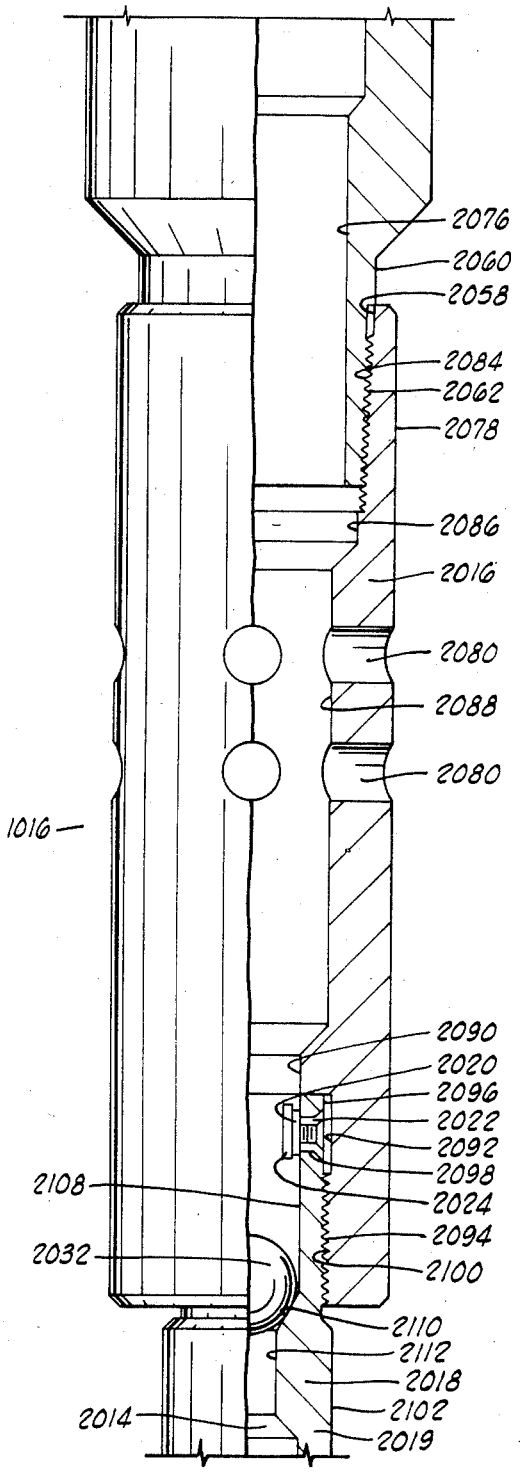
Figure 5D:
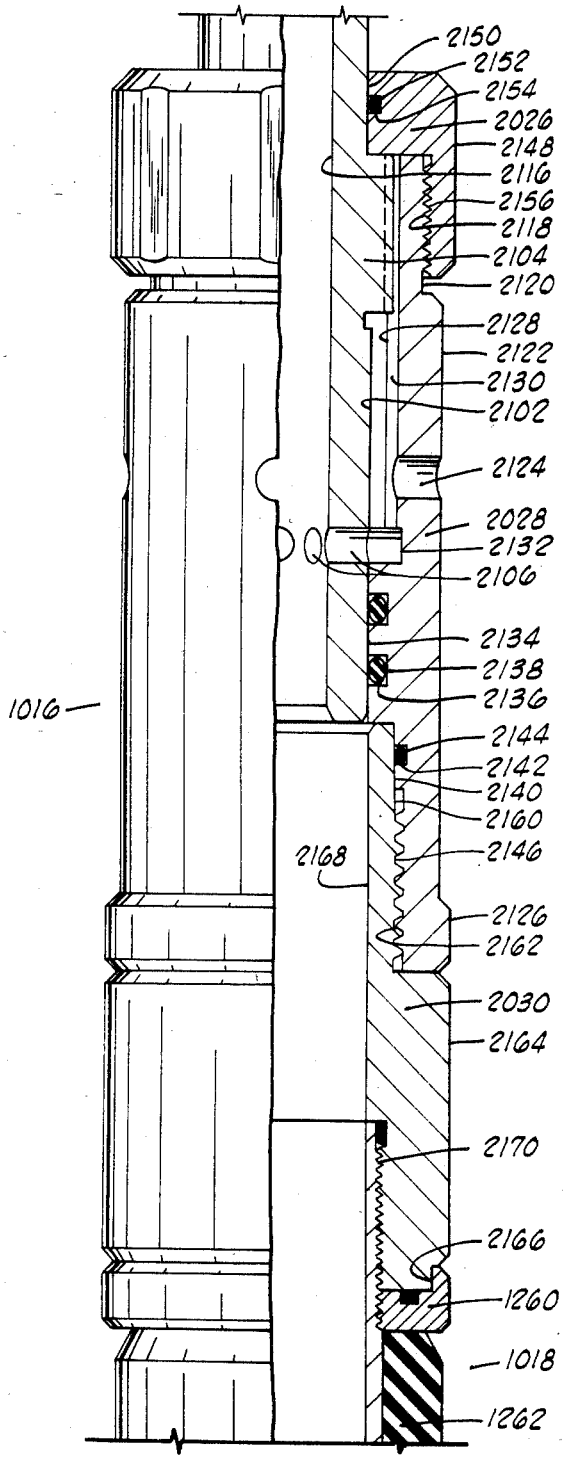

Referring to FIGS. 5B, 5C and 5D, the bypass assembly 1016 of the second embodiment 1000 of the retrievable straddle packer is shown.

The bypass assembly 1016 comprises upper bypass body 2010, upper mandrel 2012, bypass connector 2014, upper bypass adapter 2016, bypass mandrel assembly 2018, bypass keeper ring 2026, lower bypass body 2028, lower bypass adapter 2030 and ball sealer 2032.

The upper bypass body 2010 comprises an elongated annular member having, on the one end thereof, a plurality of threaded apertures 2034 receiving a plurality of releasable threaded fasteners 2036 therein to retain the lower shoe 1118 of the upper packer assembly 1014 therein; on the exterior thereof; first cylindrical portion 2038, second cylindrical portion 2040, and threaded surface 2042; and on the interior thereof, first cylindrical bore 2044 having longitudinal passageway 2046 therein extending throughout a portion of the bore 2044 to one end of the upper bypass body 2010.

The upper mandrel 2012 comprises an elongated annular member having, on the exterior thereof, threaded surface 2047 which releasably threadedly engages slip body 1030 and upper packer shoe 1110, first cylindrical portion 2048 having packer elements 1112 and 1116 as well as spacer 1114 slidably retained thereon, second cylindrical portion 2050 having, in turn, lug 2052 thereon which is slidably received in longitudinal passageway 2046 of upper bypass body 2010 to engage the same, and third cylindrical portion 2054; and, on the interior thereof, cylindrical bore 2056 therethrough.

The bypass connector 2014 comprises an elongated annular member having, on the exterior thereof, first cylindrical portion 2058 having, in turn, a plurality of apertures 2061 therein, second cylindrical portion 2060, and threaded surface 2062 and, on the interior thereof, first cylindrical bore 2064, threaded bore 2066, second cylindrical bore 2068 having a plurality of apertures 2061 therein, third cylindrical bore 2070 having, in turn, annular recess 2072 therein containing annular seal 2074 therein which slidably sealingly engages third cylindrical portion 2054 of upper mandrel 2012, and fourth cylindrical bore 2076.

The upper bypass adapter 2016 comprises an elongated annular member having, on the exterior thereof, cylindrical portion 2078 having, in turn, a plurality of apertures 2080 therein and, on the interior thereof, first cylindrical bore 2082, first threaded bore 2084 which releasably, threadedly engages threaded surface 2062 of upper bypass body 2010, second cylindrical bore 2086, third cylindrical bore 2088 having, in turn, a plurality of apertures 2080 therein, fourth cylindrical bore 2090, fifth cylindrical bore 2092 and threaded bore 2094.

The bypass mandrel assembly 2018 comprises a bypass mandrel 2019, washer 2020, screw 2022 and nut 2024.

The bypass mandrel 2019 comprises an elongated annular member having, on the exterior thereof, first cylindrical portion 2096 having, in turn, a plurality of apertures 2098 therein, threaded surface 2100, and second cylindrical portion 2102 having, in turn, a plurality of lugs 2104 thereon and a plurality of apertures 2106 therein and, on the interior thereof, first cylindrical bore 2108 having a plurality of apertures 2098 therein, first annular frusto-conical surface 2110, second cylindrical bore 2112, second annular frusto-conical surface 2114 and third cylindrical bore 2116 having, in turn, a plurality of apertures 2106 therein.

Each aperture 2098 has installed therethrough a screw 2022 having a washer 2020 and nut 2024 releasably retained thereon.

Releasably retained by means of a plurality of screws 2022 each having a washer 2020 and nut 2024 thereon in first cylindrical bore 2108 and first annular frusto-conical surface 2110 of upper bypass mandrel 2019 is ball sealer 2032.

The lower bypass body 2028 comprises an elongated annular member having, on the exterior thereof, threaded surface 2118, first cylindrical portion 2120, second cylindrical portion 2122 having, in turn, a plurality of apertures 2124 therein, and cylindrical portion 2126 and, on the interior thereof, first cylindrical bore 2128 having, in turn, a plurality of elongated axial recesses 2130 therein each of which slidably receives a lug 2104 on the bypass mandrel 2019 therein, second cylindrical bore 2132, third cylindrical bore 2134 having, in turn, a plurality of annular recesses 2136 therein each containing an annular seal 2138 therein which slidingly, sealingly engages second cylindrical portion 2102 of bypass mandrel 2019, fourth cylindrical bore 2140 having, in turn, annular recess 2142 therein containing annular seal 2144 therein, and threaded bore 2146.

The bypass keeper ring 2026 comprises an annular member having, on the exterior thereof, cylindrical portion 2148 and, on the interior thereof, cylindrical bore 2150 having, in turn, annular recess 2152 therein containing annular seal 2154 therein slidingly, sealingly engaging cylindrical portion 2102 of bypass mandrel 2019 and threaded bore 2156 which releasably, threadedly engages threaded surface 2118 of lower bypass body 2028.

The lower bypass adapter 2030 comprises an elongated annular member having, on the exterior thereof, first cylindrical portion 2160 which has a portion thereof slidably, sealingly engaging annular seals 2144 of the lower bypass body 2028, threaded portion 2162 which releasably, threadedly engages threaded bore 2146 of lower bypass body 2028, second cylindrical portion 2164, and third cylindrical portion 2166 and, on the interior thereof, cylindrical bore 2168 and threaded bore 2170 which releasably, threadedly engages the lower mandrel 1338 which is the same as that of the first embodiment 10 of the retrievable straddle packer assembly of the present invention.

Figure 5E:
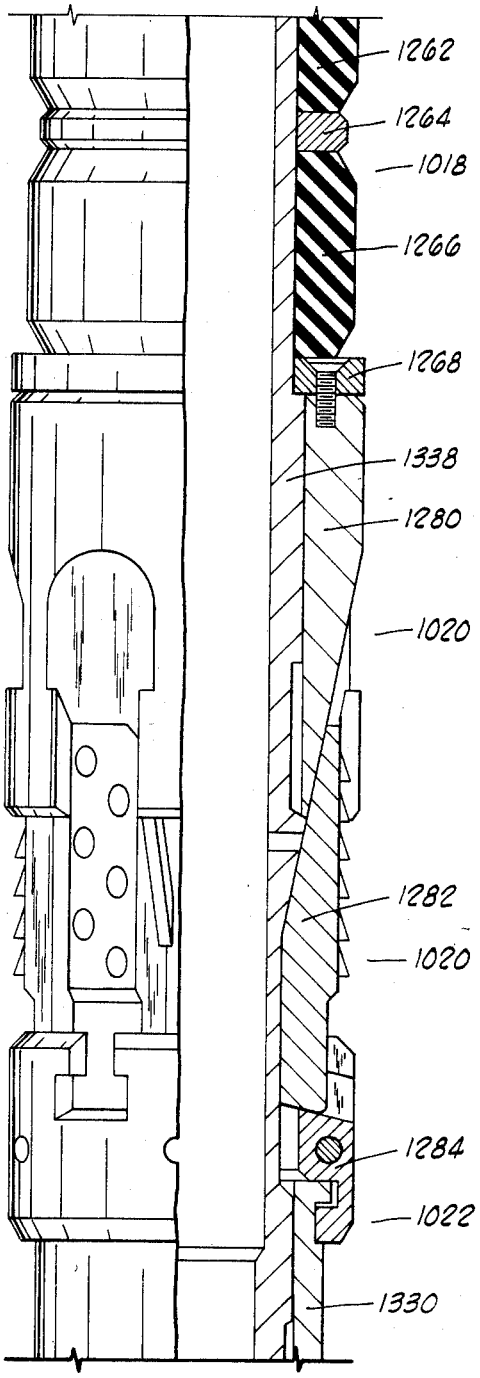
Figure 5F:
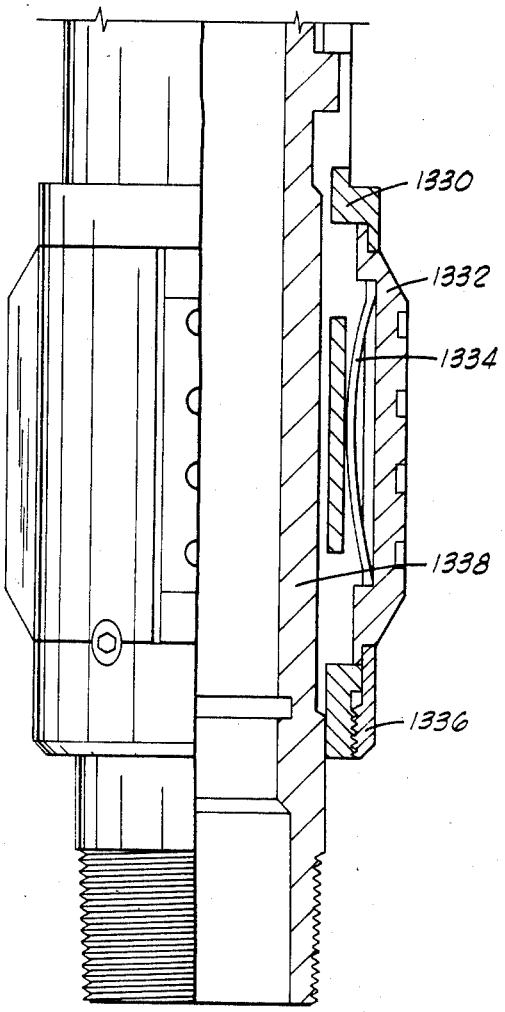

Referring to FIGS. 5D and 5E, the lower packer assembly 1018 of the second embodiment 1000 of the straddle packer assembly of the present invention comprises an upper shoe 1260, a first packer element 1262, a spacer 1264, a second packer element 1266 and lower shoe 1268. The lower packer assembly 1018 is the same as that of lower packer assembly 18 of the first embodiment 10 of the retrievable straddle packer assembly of the present invention.

The lower mechanical slip assembly 1020 comprises mechanical slip body 1280, a plurality of slips 1282, and a split slip ring collar assembly 1284. The lower mechanical slip assembly 1020 is the same as that of lower mechanical slip assembly 20 of the first embodiment 10 of the retrievable straddle packer assembly of the present invention.

The drag block assembly 1022 comprises drag block sleeve 1330, a plurality of drag blocks 1332, a plurality of drag block springs 1334, drag block sleeve nut 1336 and lower mandrel 1338. The drag block assembly 1022 is the same as that of drag block assembly 22 of the first embodiment 10 of the retrievable straddle packer assembly of the present invention.

OPERATION OF THE INVENTION

Referring to FIG. 1, the operation of the first embodiment 10 of the straddle packer assembly of the present invention is as follows.

The hydraulic hold down body 30 of the upper hydraulic slip assembly 12 is connected to the bottom of a tubing string to be run into the well bore.

When the straddle packer assembly 10 is run into the well bore, the lower drag block assembly 22 of the packer assembly 10 slidingly, resiliently engages the well bore. To set the straddle packer assembly 10 in the well bore rotate the tubing string to the right and hold right hand torque on the tubing string which causes the lug 406 on lower mandrel 338 to move from the short portion of the J-shaped slot 368 to the long portion of the J-shaped slot 368, the lug 406 having been moved from the bottom of the short portion of the J-shaped slot 368 to the top thereof (see FIG. 3) by the relative movement of the lower drag block assembly 22 with respect to the lower mandrel 338 as the packer assembly 10 is run into the well bore by means of the drag blocks 332 of drag block assembly 22 engaging the well bore. Next, while holding right hand torque on the tubing string, lower or slack-off the tubing string until the slips 282 of lower mechanical slip assembly 20 begin to take weight off the tubing string. During this operation the lug 406 on lower mandrel 338 moves downwardly in the long portion of the J-shaped slot 368 in drag block sleeve 330 causing frusto-conically shaped portion 392 of mandrel 338 to cam the slips 282 into engagement with the well bore. At this time, the right hand torque may be released with continued movement of the tubing string downwardly in the well bore until the desired amount of weight is set of the packer assembly 10.

As the packer assembly 10 picks up weight from the tubing string the downward movement of the hydraulic hold down body 30, upper mandrel 161, bypass body 162 and lower mandrel 338 with respect to the stationary slips 282 and slip body 280 cause the upper and lower packer elements 112, 116 and 262, 266 respectively, to be compressed into engagement with the well bore while the sliding sealing member 196 on the upper mandrel 161 moves downwardly past apertures 230 thereby sealingly engaging second cylindrical bore 218 of the member 162.

After the retrievable straddle packer assembly 10 is set in the well bore, the portion of the well bore located between upper packer elements 112 and 116 and the lower packer elements 262 and 266 is isolated. If it is desired to treat this isolated portion of the well bore, treating fluid may be pumped down the tubing string, through hydraulic hold down body 30 of the upper hydraulic slip assembly 12, upper mandrel 161, through apertures 192 in upper mandrel 161 and apertures 228 and 230 in bypass body 162 of bypass assembly 16 and into well bore since ball sealer 166 sealingly engages annular shoulder 188 of upper mandrel 161 and annular elastomeric member 200 sealingly engages second cylindrical bore 218 of bypass body 161 below apertures 230 therein.

When treating fluid is pumped through upper hydraulic slip assembly 12, the hydraulic slips 32 are forced into engagement with the well bore by the pressure of the treating fluid acting on the bottom 75 of each slip 32. When the slips 32 engage the well bore, this in conjunction with slips 282 engaging the well bore helps prevent movement of the straddle packer assembly 10 in the well bore in either direction. Upon the cessation of the pressure of the treating fluid acting upon the bottom 75 of the hydraulic slips 32, the slips disengage the well bore by hydraulic slip retractor springs 36 biasing the slips 32 into a retracted position within the body 30.

When finished treating the portion of the well bore, to retrieve the packer assembly 10, weight is picked up from the packer assembly 10 thereby allowing the various components thereof to return to their positions shown in drawing FIGS. 1 and 2A through 2D with drag blocks 332 and upper and lower packer element 112, 116 and 262, 266 respectively disengaging the well bore to allow the movement of the packer assembly 10 in the well bore.

When the packer assembly 10 is retrieved, the sliding sealing member 196 moves upwardly past apertures 230, allowing fluid communication between the exterior of the bypass assembly 16 of the packer assembly 10 through apertures 230, 194 and via lower mandrel 338 to equalize pressure on either side of the lower packer elements 262 and 266 to prevent damage thereto when retrieving the packer assembly. If the fluid pressure is not equalized across lower packer elements 262 and 266 prior to moving the packer assembly 10, any higher fluid pressure above the packer elements 262 and 266 than therebelow will tend to cause them to remain engaged with the well bore thereby causing them damage upon any movement of the packer assembly 10.

Referring to FIG. 4, the operation of the second embodiment 1000 of the straddle packer assembly 10 of the present invention is as follows.

The hydraulic hold down body 1030 of the upper hydraulic slip assembly 1012 is connected to the bottom of a tubing string to be run into the well bore.

When the straddle packer assembly 1000 is run into the well bore, the lower drag block assembly 1022 of the packer assembly 1000 slidingly, resiliently engages the well bore. To set the straddle packer assembly 1000 in the well bore rotate the tubing string to the right and hold right hand torque on the tubing string which causes the lug on lower mandrel 1338 to move from the short portion of the J-shaped slot to the long portion of the J-shaped slot, the lug having been moved from the bottom of the short portion of the J-shaped slot to the top thereof (see FIG. 3) by the relative movement of the lower drag block assembly 1022 with respect to the lower mandrel 1338 as the packer assembly 1000 is run into the well bore by means of the drag blocks 1332 of drag block assembly 1022 engaging the well bore. Next, while holding right hand torque on the tubing string, lower or slack-off the tubing string until the slips 1282 lower mechanical slip assembly 1020 begin to take weight off the tubing string. During this operation the lug on lower mandrel moves downwardly in the long portion of the J-shaped slot in drag block sleeve 1330 causing frusto-conically shaped portion of mandrel to cam the slips 1282 into engagement with the well bore. At this time, the right hand torque may be released with continued movement of the tubing string downwardly in the well bore until the desired amount of weight is set on the packer assembly 1000.

As the packer assembly 1000 picks up weight from the tubing string the downward movement of the hydraulic hold down body 1030, upper mandrel 1161, bypass body 1162 and lower mandrel 1338 with respect to the stationary slips 1282 and slip body 1280 cause the upper and lower packer elements 1112, 1116 and 1262, 1266, respectively, to be compressed into engagement with the well bore while the bypass mandrel 2019 moves downwardly until apertures 2106 are located below annular seals 2138.

After the retrievable straddle packer assembly 1000 is set in the well bore, the portion of the well bore located between upper packer elements 1112 and 1116 and the lower packer elements 1262 and 1266 are isolated. If it is desired to treat this isolated portion of the well bore, treating fluid may be pumped down the tubing string, through hydraulic hold down body 1030 of the upper hydraulic slip assembly 1012, upper mandrel 2012, bypass connector 2014, through apertures 2080 in bypass adapter 2030 and into the well bore since ball sealer 2032 sealingly engages first frusto-conical surface 2110 of bypass mandrel 2019.

When treating fluid is pumped through upper hydraulic slip assembly 1012, the hydraulic slips 1032 are forced into engagement with the well bore by the pressure of the treating fluid acting on the bottom of each slip 1032. When the slips 1032 engage the well bore, this in conjunction with slips 1282 engaging the well bore helps prevent movement of the straddle packer assembly 1000 in the well bore in either direction. Upon the cessation of the pressure of the treating fluid acting upon the bottom of the hydraulic slips 1032, the slips disengage the well bore by hydraulic slip retractor springs 1036 biasing the slips 1032 into a retracted position within the body 1030.

When finished treating the portion of the well bore, to retrieve the packer assembly 1000, weight is picked up from the packer assembly 1000 thereby allowing the various components thereof to return to their positions shown in drawing FIGS. 4 and 5A through 5F with drag blocks 1332 and upper and lower packer elements 112, 116 and 1262, 1266 respectively disengaging the well bore to allow the movement of the packer assembly 1000 in the well bore.

When the packer assembly 1000 is retrieved, the apertures 2106 are in fluid communication with apertures 2124, this allows fluid communication between the exterior of the bypass assembly 1016 through apertures 2124 and 2106 via lower bypass adapter 2030 and lower mandrel 1338 to equalize pressure on either side of the lower packer elements 1262 and 1266 to prevent damage thereto when retrieving the packer assembly. Otherwise, if the fluid pressure is not equalized across lower packer elements 1262 and 1266 prior to moving the packer assembly 1000, any higher fluid pressure above the packer elements 1262 and 1266 than therebelow will tend to cause them to remain engaged with the well bore thereby causing them damage upon any movement of the packer assembly 1000.

If it is desired to lengthen the bypass assembly 1016 of the second embodiment 1000 of the retrievable straddle packer assembly of the present invention to treat a larger or longer portion of the well bore, tubing may be inserted between the bottom of the bypass connector 2014 and the top of the upper bypass adapter 2016 to sealingly engage therewith to form a fluid tight flow path therebetween of any desired length. In this manner, the length of the well bore to be treated with the treating fluid may be of any desired length.

It will be obvious to those of ordinary skill in the art that modifications, additions, deletions and other changes may be made to the present invention which fall within the scope of the invention and, as such, are intended to be encompassed therein.

Thus, having described our invention we claim:

1. A retrievable straddle packer for use in wells which intersect formations of the earth and contain fluid in the well bore thereof, said retrievable straddle packer used to isolate a portion of said well bore so that a portion of said formations of the earth intersected by said well bore may thereby be contacted by treating fluid pumped through said retrievable straddle packer, said retrievable straddle packer comprising:

an upper hydraulic slip assembly for preventing movement of said retrievable straddle packer in one direction in said well bore upon actuation;

an upper packer assembly connected to the upper hydraulic slip assembly for sealing a portion of said well bore from another;

a bypass assembly located below the upper packer assembly, the bypass assembly having a first set of apertures therethrough for allowing the flow of said treating fluid from the interior of said retrievable straddle packer to a portion of said well bore and thereby a portion of said formations when said retrievable straddle packer is set in said well bore and a second set of apertures therethrough for allowing the pressure of said fluid in said well bore to equalize and flow around said retrievable straddle packer when said packer is moved in said well bore;

a lower packer assembly located below the bypass assembly for sealing a portion of said well bore from another and for isolating the portion of the well bore located between the upper packer assembly and the lower packer assembly from other portions of the well bore to allow said treating fluid to flow from the interior of said straddle packer through the first set of apertures of the bypass assembly into the portion of the well bore located between the upper packer assembly and the lower packer assembly and thereby a portion of said formations;

a lower mechanical slip assembly located below the bypass assembly for preventing movement of said retrievable straddle packer in another direction in said well bore upon actuation; and a drag block assembly.

2. The retrievable straddle packer of claim 1 wherein the upper hydraulic slip assembly comprises:

a hydraulic hold down body having a plurality of apertures therein and a bore therethrough;

a plurality of hydraulic slips located in the plurality of apertures in the hydraulic hold down body, each slip having an elongated slot extending through a portion thereof;

a plurality of hold down straps overlying the plurality of hydraulic slips, each strap overlying the elongated slot in at least one hydraulic slip and being secured to the hold down body; and a plurality of hydraulic slip retractor springs, each spring having one end abutting a hold down strap and the other end abutting a portion of a hydraulic slip.

3. The retrievable straddle packer of claim 1 wherein the upper packer assembly comprises:

an upper shoe;

a first packer element located below the upper shoe;

a spacer located below the first packer element;

a second packer element located below the spacer; and a lower shoe located below the second packer element; and the lower packer assembly comprises:

an upper shoe;

a first packer element located below the upper shoe;

a spacer located below the first packer element;

a second packer element located below the spacer; and a lower shoe located below the second packer element.

4. A retrievable straddle packer for use in wells which intersect formations of the earth and contain fluid in the well bore thereof, said retrievable straddle packer comprising:

an upper hydraulic slip assembly for preventing movement of said retrievable straddle packer in one direction in said well bore upon actuation;

an upper packer assembly connected to the upper hydraulic slip assembly for sealing a portion of said well bore from another;

a bypass assembly located below the upper packer assembly, the bypass assembly having a first set of apertures therethrough for allowing fluid flow from the interior of said retrievable straddle packer to said well bore and a formation of said formations and a second set of apertures therethrough for allowing the pressure of said fluid in said well bore to equalize around said retrievable straddle packer when said packer is moved in said well bore, the bypass assembly including:

an upper mandrel assembly;

a bypass body;

a connector nut; and a ball sealer;

a lower packer assembly located below the bypass assembly for sealing a portion of said well bore from another and for isolating the portion of the well bore located between the upper packer assembly and the lower packer assembly from other portions of the well bore to allow fluid flow from the interior of said straddle packer through the first set of apertures of the bypass assembly into the portion of the well bore located between the upper packer assembly and the lower packer assembly;

a lower mechanical slip assembly located below the bypass assembly for preventing movement of said retrievable straddle packer in another direction in said well bore upon actuation; and a drag block assembly located below the lower mechanical slip assembly.

5. The retrievable straddle packer of claim 4 wherein the upper mandrel assembly comprises:

an upper mandrel;

an annular sliding sealing member; and an annular nut.

6. A retrievable straddle packer for use in wells which intersect formations of the earth and contain fluid in the well bore thereof, said retrievable straddle packer comprising:

an upper hydraulic slip assembly for preventing movement of said retrievable straddle packer in one direction in said well bore upon actuation;

an upper packer assembly connected to the upper hydraulic slip assembly for sealing a portion of said well bore from another;

a bypass assembly located below the upper packer assembly, the bypass assembly having a first set of apertures therethrough for allowing fluid flow from the interior of said retrievable straddle packer to said well bore and a formation of said formations and a second set of apertures therethrough for allowing the pressure of said fluid in said well bore to equalize around said retrievable straddle packer when said packer is moved in said well bore, the bypass assembly including:

an upper bypass body;

an upper mandrel;

a bypass connector;

an upper bypass adapter;

a bypass mandrel assembly;

a bypass keeper ring;

a lower bypass body;

a lower bypass adapter; and a ball sealer;

a lower packer assembly located below the bypass assembly for sealing a portion of said well bore from another and for isolating the portion of the well bore located between the upper packer assembly and the lower packer assembly from other portions of the well bore to allow fluid flow from the interior of said straddle packer through the first set of apertures of the bypass assembly into the portion of the well bore located between the upper packer assembly and the lower packer assembly;

a lower mechanical slip assembly located below the bypass assembly and lower packer assembly for preventing movement of said retrievable straddle packer in another direction in said well bore upon actuation; and a drag block assembly.

7. The retrievable straddle packer of claim 6 wherein the bypass mandrel assembly comprises:

a bypass mandrel;

a screw;

a washer; and a nut.

8. The retrievable straddle packer of claim 1 wherein the lower mechanical slip assembly comprises:

a mechanical slip body;

a plurality of slips slidable on the mechanical slip body; and a split ring collar assembly retaining the plurality of slips on the mechanical slip body.

9. The retrievable straddle packer of claim 7 wherein the split ring collar assembly comprises:

a plurality of arcuate collars; and a plurality of threaded fasteners securing the plurality of arcuate collars to each other to form an annular collar assemblage.

10. The retrievable straddle packer of claim 1 wherein the lower drag block assembly comprises:

a drag block sleeve having a plurality of recesses therein and a bore therethrough;

a plurality of drag blocks, each block located in a recess in the drag block sleeve;

a plurality of drag block springs, each spring having a portion thereof engaging a portion of each drag block and a portion of the drag block sleeve;

a drag block sleeve nut having a portion thereof engaging a portion of each drag block and being releasably secured to the drag block sleeve; and a lower mandrel extending through the bore in the drag block sleeve.

11. The retrievable straddle packer of claim 2 wherein:

the upper packer assembly comprises:

an upper shoe;

a first packer element located below the upper shoe;

a spacer located below the first packer element;

a second packer element located below the spacer; and a lower shoe located below the second packer element; and the lower packer assembly comprises:

an upper shoe;

a first packer element located below the upper shoe;

a spacer located below the first packer element;

a second packer element located below the spacer; and a lower shoe located below the second packer element.

12. The retrievable straddle packer of claim 11 wherein the bypass assembly comprises:

an upper mandrel assembly;
a bypass body;
a connector nut; and
a ball sealer.

13. The retrievable straddle packer of claim 12 wherein the lower mechanical slip assembly comprises:
a mechanical slip body;
a plurality of slips slidable on the mechanical slip body; and
a split ring collar assembly retaining the plurality of slips on the mechanical slip body.

14. The retrievable straddle packer of claim 13 wherein:
the lower drag block assembly comprises:
a drag block sleeve having a plurality of recesses therein and a bore therethrough;
a plurality of drag blocks, each block located in a recess in the drag block sleeve;
a plurality of drag block springs, each spring having a portion thereof engaging a portion of each drag block and a portion of the drag block sleeve;
a drag block sleeve nut having a portion thereof engaging a portion of each drag block and being releasably secured to the drag block sleeve; and
a lower mandrel extending through the bore in the drag block sleeve.

15. The retrievable straddle packer of claim 11 wherein the bypass assembly comprises:
an upper bypass body;
an upper mandrel;
a bypass connector;
an upper bypass adapter;
a bypass mandrel assembly;
a bypass keeper ring;
a lower bypass body;
a lower bypass adapter; and
a ball sealer.

16. The retrievable straddle packer of claim 15 therein the lower mechanical slip assembly comprises:
a mechanical slip body;
a plurality of slips slidable on the mechanical slip body; and
a split ring collar assembly retaining the plurality of slips on the mechanical slip body.

17. The retrievable straddle packer of claim 16 wherein the drag block assembly comprises:
a drag block sleeve having a plurality of recesses therein and a bore therethrough;
a plurality of drag blocks, each block located in a recess in the drag block sleeve;
a plurality of drag block springs, each spring having a portion thereof engaging a portion of each drag block and a portion of the drag block sleeve;
a drag block sleeve nut having a portion thereof engaging a portion of each drag block and being releasably secured to the drag block sleeve; and
a lower mandrel extending through the bore in the drag block sleeve.

18. A tubing conveyed retrievable straddle packer for use in wells which intersect formations of earth and contain fluid in the wellbore thereof, said retrievable straddle packer comprising:
an upper hydraulic slip assembly for preventing movement of said retrievable straddle packer in one direction in said wellbore upon actuation comprising:
a hydraulic hold down body having a plurality of apertures therein and a bore therethrough;
a plurality of hydraulic slips located in the plurality of apertures in the hydraulic hold down body, each slip having an elongated slot extending through a portion thereof;
a plurality of hold down straps overlying the plurality of hydraulic slips, each strap overlying the elongated slot in at least one hydraulic slip and being secured to the hold down body; and
a plurality of hydraulic slip retractor springs, each spring having one end abutting a hold down strap and the other end abutting a portion of a hydraulic slip;
an upper packer assembly connected to the upper hydraulic slip assembly for sealing a portion of said wellbore from another comprising:
an upper shoe;
a first packer element located below the upper shoe;
a spacer located below the first packer element;
a second packer element located below the spacer; and
a lower shoe located below the second packer element;
a bypass assembly located below the upper packer assembly, the bypass assembly having a first set of apertures therethrough for allowing fluid flow from the interior of said retrievable straddle packer to said wellbore and a formation of said formations and a second set of apertures therethrough for allowing the pressure of said fluid in said wellbore to equalize around said retrievable straddle packer when said packer is moved in said wellbore comprising:
an upper mandrel assembly;
a bypass body;
a connector nut; and
a ball sealer;
a lower packer assembly located below the bypass assembly for sealing a portion of said wellbore from another and for isolating the portion of the wellbore located between the upper packer assembly and the lower packer assembly from other portions of the wellbore to allow fluid flow from the interior of said straddle packer through the first set of apertures of the bypass assembly into the portion of the wellbore located between the upper packer assembly and the lower packer assembly comprising:
an upper shoe;
a first packer element located below the upper shoe;
a spacer located below the first packer element;
a second packer element located below the spacer; and
a lower shoe located below the second packer element;
a lower mechanical slip assembly located below the bypass assembly for preventing movement of said retrievable straddle packer in another direction in said wellbore upon actuation comprising:
a mechanical slip body;
a plurality of slips slidable on the mechanical slip body; and
a split ring collar assembly retaining the plurality of slips on the mechanical slip body; and a drag block assembly comprising:
a drag block sleeve having a plurality of recesses therein and a bore therethrough;
a plurality of drag blocks, each block located in a recess in the drag block sleeve;

a plurality of drag block springs, each spring having a portion thereof engaging a portion of each drag block and a portion of the drag block sleeve;

a drag block sleeve nut having a portion thereof engaging a portion of each drag block and being releasably secured to the drag block sleeve; and a lower mandrel extending through the bore in the drag block sleeve.

19. A tubing conveyed retrievable straddle packer for use in wells which intersect formations of the earth and contain fluid in the wellbore thereof, said retrievable straddle packer comprising:

an upper hydraulic slip assembly for preventing movement of said retrievable straddle packer in one direction in said wellbore upon actuation comprising:

a hydraulic hold down body having a plurality of apertures therein and a bore therethrough;

a plurality of hydraulic slips located in the plurality of apertures in the hydraulic hold down body, each slip having an elongated slot extending through a portion thereof;

a plurality of hold down straps overlying the plurality of hydraulic slips, each strap overlying the elongated slot in at least one hydraulic slip and being secured to the hold down body; and a plurality of hydraulic slip retractor springs, each spring having one end abutting a hold down strap and the other end abutting a portion of a hydraulic slip;

an upper packer assembly connected to the upper hydraulic slip assembly for sealing a portion of said wellbore from another comprising:

an upper shoe;

a first packer element located below the upper shoe;

a spacer located below the first packer element;

a second packer element located below the second packer element;

a lower shoe located below the second packer element;

a bypass assembly located below the upper packer assembly, the bypass assembly having a first set of apertures therethrough for allowing fluid flow from the interior of said retrievable straddle packer to said wellbore and a formation of said formations and a second set of apertures therethrough for allowing the pressure of said fluid in said wellbore to equalize around said retrievable straddle packer when said packer is moved in said wellbore comprising:

an upper bypass body;

an upper mandrel;

a bypass connector;

an upper bypass adapter;

a bypass mandrel assembly;

a bypass keeper ring;

a lower bypass body;

a lower bypass adapter; and a ball sealer;

a lower packer assembly located below the bypass assembly for sealing a portion of said wellbore from another and for isolating the portion of the wellbore located between the upper packer assembly and the lower packer assembly from other portions of the wellbore to allow fluid flow from the interior of said straddle packer through the first set of apertures of the bypass assembly into the portion of the wellbore located between the upper packer assembly and the lower packer assembly comprising:

an upper shoe;

a first packer element located below the upper shoe;

a spacer located below the first packer element;

a second packer element located below the spacer; and a lower shoe located below the second packer element; and a drag block assembly comprising:

a drag block sleeve having a plurality of recesses therein and a bore therethrough;

a plurality of drag blocks, each block located in a recess in the drag block sleeve;

a plurality of drag block springs, each spring having a portion thereof engaging a portion of each drag block and a portion of the drag block sleeve;

a drag block sleeve nut having a portion thereof engaging a portion of each drag block and being releasably secured to the drag block sleeve; and a lower mandrel extending through the bore in the drag block sleeve.

* * * * *